US005711455A

United States Patent [19]

Elliott

[11] Patent Number: 5,711,455

[45] Date of Patent: Jan. 27, 1998

[54] TUBE PRODUCT DISPENSER

[76] Inventor: Howard V. Elliott, Box 1708, Bethel, Ak. 99559

[21] Appl. No.: 548,203

[22] Filed: Oct. 25, 1995

[51] Int. Cl.[6] ..... B65D 35/28

[52] U.S. Cl. ..... 222/103

[58] Field of Search ..... 222/102, 103, 222/97, 105, 390

[56] References Cited

U.S. PATENT DOCUMENTS

| | | | |
|---|---|---|---|
| 1,711,755 | 5/1929 | Smith . | |
| 1,754,084 | 4/1930 | Cornelius . | |
| 1,989,713 | 2/1935 | Smith et al. . | |
| 2,496,004 | 1/1950 | Geyer . | |
| 3,915,342 | 10/1975 | Van Bussel | 222/103 |
| 4,585,147 | 4/1986 | Wodnicki | 222/103 |

FOREIGN PATENT DOCUMENTS

| | | | |
|---|---|---|---|
| 626466 | 9/1927 | France | 222/103 |

*Primary Examiner*—Philippe Derakshani
*Attorney, Agent, or Firm*—Schmeiser, Olsen & Watts

[57] ABSTRACT

A dispenser designed to be used in conjunction with a compressible tube of fluent material. The dispenser includes a pair of flexible bands between which the tube is inserted. A compressing mechanism is employed to press the bands together and thereby cause a localized area of the tube to be compressed. Movement of the compressing mechanism is achieved by turning a bottom-located handle. The handle is connected to an inner housing having a helical thread to which the compressing mechanism is engaged. Rotation of the handle causes the helical thread to rotate and thereby forces the compressing mechanism to move along the bands and thereby compress adjacent portions of the contained tube.

10 Claims, 1 Drawing Sheet

TUBE PRODUCT DISPENSER

FIELD OF THE INVENTION

The invention is in the field of dispensing devices. More particularly, the invention is a device adapted to incrementally squeeze a viscous liquid product from a flexible tube-type reservoir. The device makes use of two flexible metal bands that sandwich the reservoir and are compressed together by a movable roller assembly.

BACKGROUND OF THE INVENTION

Many viscous liquid products are often packaged in a tube having flexible walls. Toothpaste and dental adhesive are two such products commonly packaged in this manner. To use the product, a consumer first removes the cap from the end of the tube and then uses his or her hand(s) to squeeze the sides of the tube and thereby cause a portion of the tube's contents to be expelled from the tube's outlet.

There are a number of disadvantages associated with conventional tube-type containers. For users who have low finger or hand strength, it can be extremely difficult to squeeze the tube with sufficient force to cause the tube's contents to be expelled. For people who carry tube contained products with them, such as users of denture adhesive, inadvertent pressure can be applied to the tube during transport and thereby cause some of the contained material to be expelled from the tube. As a result, the liquid material can come into contact with a user's clothing or other items adjacent to the tube. An additional problem that some people have with conventional tube-type containers is that they sometimes wish to carry the tube in a manner wherein the tube and its description of its contents are not readily visible. This is difficult with most tube-type container's due to their distinctive shape and easy-to-read external markings.

SUMMARY OF THE INVENTION

The invention is a device designed to inwardly receive a conventional tube-type reservoir of a fluid product such as dental adhesive or toothpaste. The device includes a tubular outer housing, a tubular inner housing, a pair of flexible compressor bands substantially located within the inner housing, and a roller assembly designed to move along the bands and press them together.

The roller assembly is engaged to a helical screw thread located on the inner housing. Movement of the roller assembly is achieved by manually rotating a bottom-located handle that is fixed to the inner housing and will cause said housing to also rotate. Since the compressor bands are fixed relative to the movable inner housing and the roller assembly cannot rotate about the bands, rotation of the inner housing will cause the roller assembly to travel up or down along the length of the bands. As the roller assembly moves along the bands in a direction toward the tube's outlet, it squeezes the bands together. As the bands pushed toward each other, they exert pressure on the sides of the tube, thereby causing the tube's contents to be expelled from its outlet.

DETAILED DESCRIPTION OF THE DRAWINGS

Figure 1:
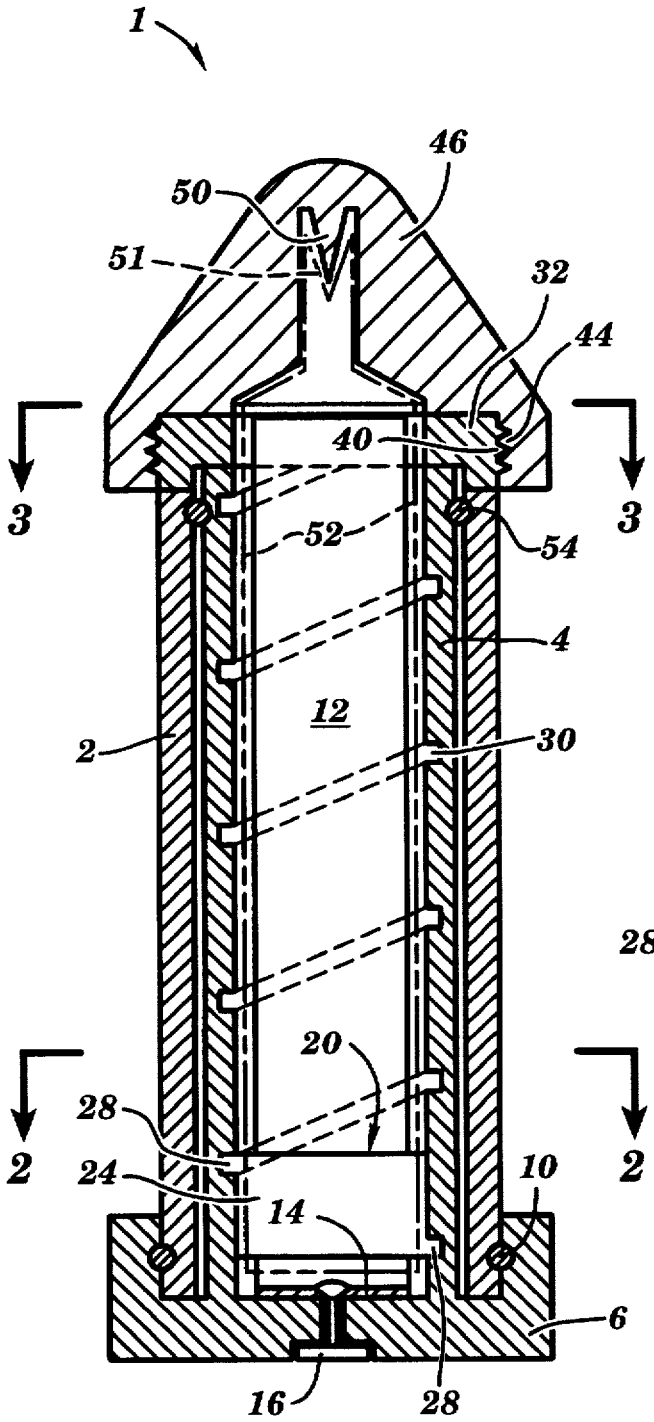
FIG. 1 is an elevational view in cross-section of a tube product dispenser in accordance with the invention. A tube of a liquid product such as dental adhesive is shown in phantom.
Figure 3:
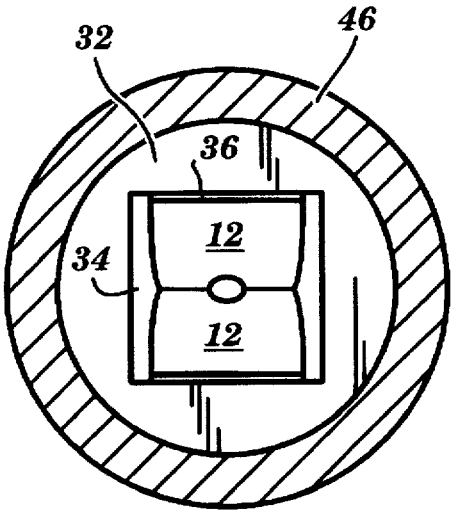
FIG. 3 is a plan view of the dispenser shown in FIG. 1 taken at the plane labeled 3—3.

Referring now to the drawings in greater detail, wherein like reference characters refer to like parts throughout the several figures, there is shown by the numeral 1 a tube product dispenser in accordance with the invention.

FIG. 1 provides a cross-sectional, elevational view of the dispenser 1. The dispenser includes a tubular outer housing 2 and a tubular inner housing 4. A manually graspable handle 6 is located at the bottom of the dispenser and is rigidly attached to the inner housing. The handle has a knurled outer surface and is rotatable relative to the outer housing. A snap ring 10 is used to secure the handle to the outer housing. There is a loose fit between the handle and ring, thereby allowing the ring to act as a bearing upon which the handle can rotate about the bottom portion of the outer housing.

Located within the inner housing are a pair of rectangular compressor bands 12 that are preferably made from a flexible metal or plastic material. Each band is in the form of a thin rectangular strip similar to a leaf spring. The bottom end 14 of each band is rigidly affixed to an anchor pin 16. The pin is loosely secured to the handle 6 in a manner whereby the handle can rotate relative to the pin.

Figure 2:
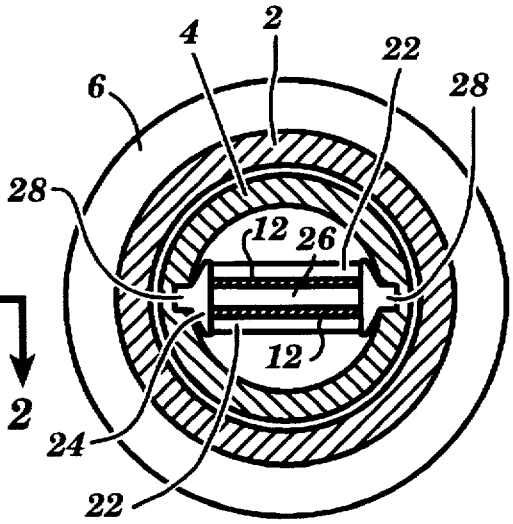
FIG. 2 is a plan view of the dispenser shown in FIG. 1 taken at the plane labeled 2—2.

Also located within the inner housing but exterior to the bands 12 is a compressing means in the form of a roller assembly 20. The assembly includes a pair of rollers 22 (note FIG. 2) that are rotatably secured to a support member 24. The rollers are positioned whereby each roller is associated with and presses on the flat outer surface of one of the bands 12. As can be seen in FIG. 2, there is only a small gap 26 between the bands when they are pressed together by the rollers. This gap is sized so that when a tube-type container is located between the bands 12, its sides will be will be completely pressed together in the vicinity of the roller assembly.

A pair of pins 28 are secured to the outer surface of the support member 24 and are engaged to a helical screw thread 30 located on the inner surface of the inner housing. The pins are designed to slide within said thread.

The top of the device 1 includes a band positioning ring 32. The ring has a rectangular or square central aperture 34 into which the top ends 36 of the two bands 12 are received. The ring is rigidly secured to the outer housing 2 and forms a top end portion of said housing.

In the preferred embodiment, the exterior of ring 32 includes threads 40 that are complementary to interior-located threads 44 of a cap 46. The cap is designed to removably seal the top end of the device and may include a seal member 50 that can be received within the outlet 51 of a product tube 52 for sealing said tube. It should be noted that the cap 46 is optional and the tube 52 can be a conventional tube of a viscous liquid product such as dental adhesive or toothpaste that is sealed with its own cap.

Located below ring 32 is a second snap ring 54. This ring is secured to the outer housing 2 and the inner housing 4. The ring attaches the two housings together and prevents axial movement of either housing. However, the ring also acts as a bearing whereby either housing can rotate relative to the other.

To initially use the device, cap 46 is removed and a tube 52 of fluent product such as toothpaste or denture adhesive is inserted into the device through ring 32 and lodged between the two bands 12. It should be noted that the roll assembly should be located proximate the bottom of the device (near pin 60) prior to placement of a tube 52 within the device. Handle 6 is then manually rotated to cause the roller assembly to move upwardly on the bands.

The movement of the roller assembly occurs since rotation of the handle causes the inner housing to rotate. As the housing rotates, the pins 28 of the support member 24 are forced upwardly as they slide within the helical thread 30. It should be noted that the support member 24 cannot rotate since its rollers are flush against the flat outer surfaces of the stationary bands 12. The bands cannot rotate because their top ends are non-movably engaged to the relatively stationary ring 32. Since the anchor pin 16 (attached to the bottom ends of the bands) is a loose fit within the handle, turning of the handle does not apply a rotative force on the bands 12.

As the roller assembly moves upwardly on the bands, the rollers force the adjacent portions of the bands in an inward direction. As the bands are pressed together, they apply a compressive pressure on the exterior walls of the tube 52. The pressure on the tube causes a portion of the tube's contents to be expelled from its outlet 51.

In the above manner, one is able to apply considerable compressive force on the tube 52 by merely rotating the handle 6 and making use of the multiplication of force achieved through the use of the helical screw thread. This greatly facilitates the ability of a person having low hand strength to squeeze a fluent product from a tube 52.

In addition, once the tube is located within the device 1, the tube and its markings are not readily discernable. This affords a user with a degree of privacy since other people cannot ascertain the nature of the fluent product or even that the user is carrying a tube of a fluent product.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A dispensing device comprising:

a tubular outer housing:

a tubular inner housing:

a rotatable handle secured to said inner housing:

first and second elongated flexible bands coupled to one end of said outer housing;

a compressing means adapted to press together adjacent portions of said first and second bands wherein the compressing means includes first and second rollers rotatably secured to a support member and wherein said first roller contacts an outer surface of the first band and the second roller contacts an outer surface of the second band; and means connected to the inner housing and to the compressing means for causing the compressing means to move in a direction parallel to a longitudinal axis of the inner housing when said handle is rotated.

2. The device of claim 1 further comprising a cap releasably secured to the outer housing.

3. The device of claim 1 wherein a bottom end of each of said bands is anchored to the handle.

4. A dispensing device comprising:

a tubular outer housing;

a tubular inner housing;

a rotatable handle secured to said inner housing;

first and second elongated flexible bands coupled to one end of said outer housing wherein a top end of the outer housing includes a receiving means adapted to fixedly receive a top end of each of said first and second bands;

a compressing means adapted to press together adjacent portions of said first and second bands; and means connected to the inner housing and to the compressing means for causing the compressing means to move in a direction parallel to a longitudinal axis of the inner housing when said handle is rotated.

5. The device of claim 4 wherein the receiving means includes a central aperture having first and second flat sides and wherein each of said sides is complementary in shape to the top end of the associated bands whereby each of said ends of said bands fit snugly against an associated one of said flat sides of said aperture and are prevented from movement by said snug fit.

6. The device of claim 4 wherein in the receiving means forms a top end portion of the outer housing and wherein the aperture of the receiving means is rectangular.

7. The device of claim 4 further comprising a cap releasably secured to the outer housing.

8. A dispensing device comprising:

a tubular outer housing;

a tubular inner housing;

a rotatable handle secured to said inner housing;

first and second elongated flexible bands coupled to one end of said outer housing;

a compressing means adapted to press together adjacent portions of said first and second bands;

means connected to the inner housing and to the compressing means for causing the compressing means to move in a direction parallel to a longitudinal axis of the inner housing when said handle is rotated wherein the means for causing the compressing means to move comprises a helically-oriented screw thread located on the inner housing and rotatable therewith, and wherein the compressing means includes at least one outwardly extending pin that is engaged to said screw thread and wherein when said handle is rotated, said at least one pin is forced by said screw thread to move in a direction parallel to a longitudinal axis of the inner housing.

9. The device of claim 8 wherein the compressing means includes two outwardly extending pins located on opposite sides of the compressing means and wherein both of said outwardly extending pins engage the screw thread located on the inner housing.

10. The device of claim 8 further comprising a cap releasably secured to the outer housing.

* * * * *